United States Patent [19]

Frosch

[11] Patent Number: 4,651,386

[45] Date of Patent: Mar. 24, 1987

[54] UNIVERSAL TEXTILE MACHINE FOR OPTIONALLY MANUFACTURING LONGITUDINALLY AND/OR RANDOMLY ORIENTED FIBER FLEECE

[75] Inventor: Werner Frosch, Schwanewede, Fed. Rep. of Germany

[73] Assignee: Hollingsworth GmbH, Fed. Rep. of Germany

[21] Appl. No.: 841,071

[22] Filed: Mar. 18, 1986

[30] Foreign Application Priority Data

Mar. 26, 1985 [DE] Fed. Rep. of Germany ..... 3510951

[51] Int. Cl.[4] ..... D01G 15/26

[52] U.S. Cl. ..... 19/98; 19/106 R

[58] Field of Search ..... 19/106 R, 302, 98

[56] References Cited

U.S. PATENT DOCUMENTS

| | | | |
|---|---|---|---|
| 372,771 | 11/1887 | Senior et al. | 19/106 R |
| 1,833,811 | 11/1931 | Allen et al. | 19/106 R |
| 3,867,741 | 2/1975 | Frolov et al. | 19/106 R |
| 3,983,273 | 9/1976 | Elliott | 19/106 R |
| 4,523,350 | 6/1985 | Schmiedgen et al. | 19/98 |
| 4,566,153 | 1/1986 | Frosch | 19/106 R |

FOREIGN PATENT DOCUMENTS

| | | | |
|---|---|---|---|
| 1049583 | 10/1983 | U.S.S.R. | 19/106 R |

*Primary Examiner*—Louis K. Rimrodt

*Attorney, Agent, or Firm*—Townsend and Townsend

[57] ABSTRACT

A carding machine is provided with two doffers. At least one of the doffers has an intermediate roller coordinated thereto. The doffer roller and the coordinated intermediate roller are shiftable into two different operating settings. In a first operating setting the intermediate roller is out of operation and the doffer roller works in a usual manner in combination with the main cylinder. In the other setting the doffer roller is out of operational contact with the main cylinder, and the intermediate roller, which has the same direction of rotation as the main cylinder, is positioned so as to transfer the fibers from the main cylinder to the doffer roller. The second doffer roller may have a second intermediate roller coordinated thereto. The fiber fleeces leaving both doffer rollers are combined to form a compound fiber fleece.

10 Claims, 7 Drawing Figures

UNIVERSAL TEXTILE MACHINE FOR OPTIONALLY MANUFACTURING LONGITUDINALLY AND/OR RANDOMLY ORIENTED FIBER FLEECE

BACKGROUND OF THE INVENTION

The invention relates to a universal textile or carding machine for selectively producing either a longitudinally oriented fiber fleece, a tangle-fibered fleece, or a mixture of both such fleeces.

A universal textile machine for selectively producing either longitudinally oriented webs or tangled webs is already known (DE-Pat. No. 3 334 912, U.S. equivalent 4,566,153). Such a textile machine comprises a main cylinder and carding elements cooperating therewith, a fiber drawing-in device and a doffer, whose card clothings adjoin the circumferential area of the main cylinder, and further comprises a supplementary intermediate roller furnished with a card clothing and the shaft of which may be positioned into a first or a second position by a setting mechanism for adjusting the distance between the doffer roller and the main cylinder, by selecting the position such that when the doffer roller is put into its operating position, the card clothing of the intermediate roller is out of operational engagement relative to the card clothings of the main cylinder and of the doffer roller, and that in the second position, when the doffer roller is operationally separated from the main cylinder, the card clothing of the intermediate roller is in its operating position both relative to the card clothing of the main cylinder and of the doffer roller. The main cylinder and the intermediate roller have the same direction of rotation.

Depending on the correlated position of the intermediate roller and of the doffer roller, either longitudinally fibered or tangle-fibered fleeces may be produced.

SUMMARY OF THE INVENTION

It is an object of the invention to improve such a universal textile machine so as to increase the speed of production and to permit the manufacture of a larger variety of fleeces.

This and other objects are achieved by providing a second doffer roller in the direction of rotation of the main cylinder behind the first doffer roller, and that a device for combining the webs leaving both doffers is provided. Such a universal textile machine allows the production either of a longitudinally oriented fiber fleece or of a combination of a longitudinally oriented fiber fleece and a tangled fleece. Such a combined fleece is suitable for applications, in which a lower elasticity of the fleece is required than may be achieved with a tangled fleece.

According to a further improvement, the second doffer has a coordinated second intermediate roller, wherein both rollers and its coordinated intermediate rollers are shiftable into one of two positions, so that each of said doffer units may be set to the production of a longitudinally oriented and/or a tangled fleece.

Preferably, each of said doffer rollers and of said intermediate rollers have an adjusting means to adjust the clearance to the main cylinder in order to allow for an adjustment of the amount of fibers transferred to each of said doffer units.

According to a further development, an adjusting means is provided in order to adjust the axial distance between each of said doffer rollers and the coordinated intermediate roller in order to influence the transfer of fibers from the intermediate roller onto the doffer.

The speed of rotation of each of said intermediate rollers may be adjusted independently of each other.

The intermediate rollers may be interchangeable.

Preferably the first intermediate roller has a smaller diameter than the second intermediate roller and has a higher speed of rotation. By this, the structure of the fleece may be varied to a certain extent.

The two sets of rollers in said doffer units may be adjusted independently of each other to one of their two settings, so that a compound fiber fleece of a homogeneous or a heterogeneous structure may be produced.

BRIEF DESCRIPTION OF THE DRAWINGS

The invention is further described with reference to the accompanying drawings which illustrate preferred embodiments by way of example and in which.

DETAILED DESCRIPTION OF A PREFERRED EMBODIMENT

Figure 1:
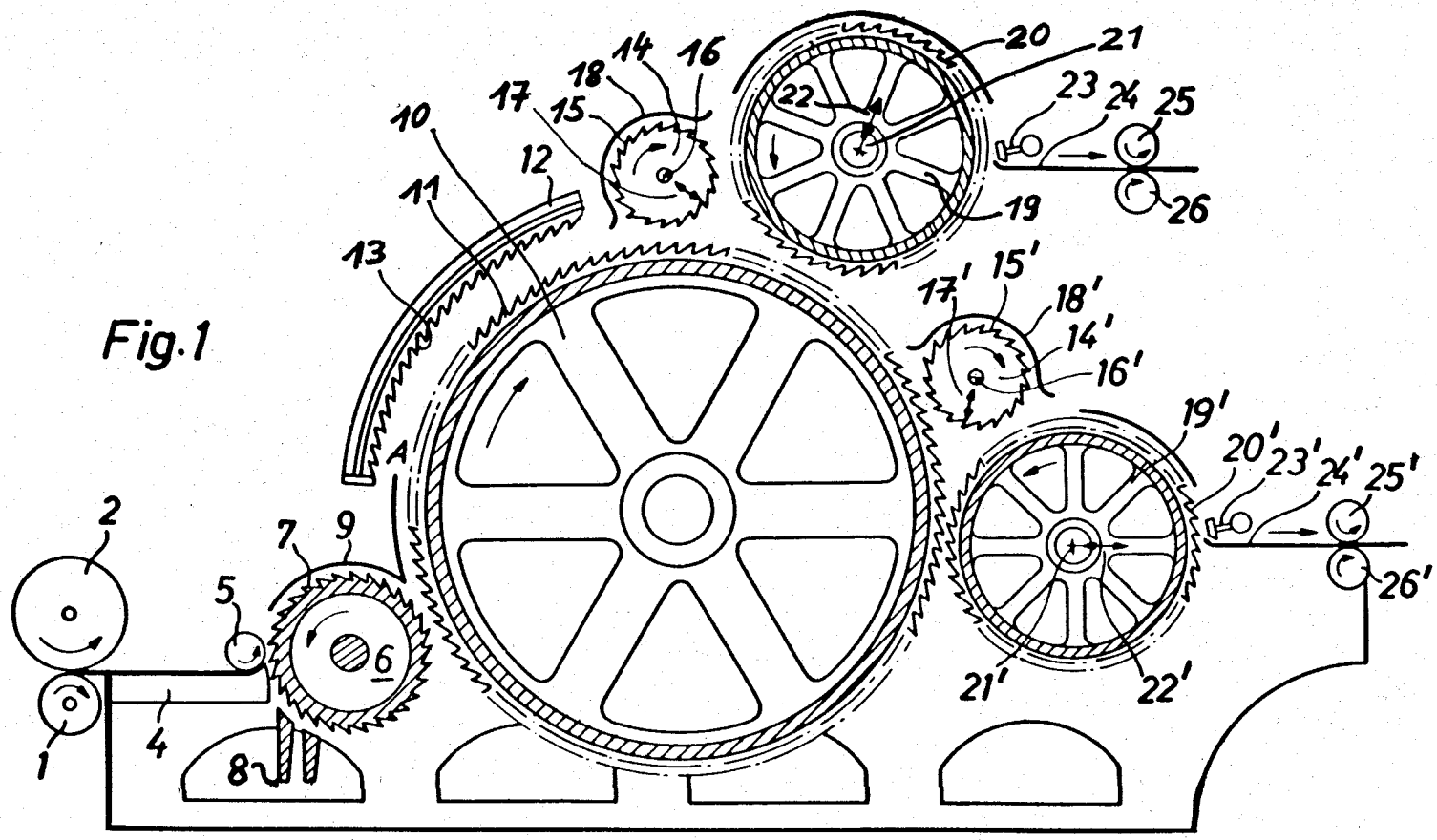
FIG. 1 is a vertical section trough a universal machine.

In the drawings the same components are given the same reference numerals, those referring to the components of the second doffer being given an apostrophe.

The universal textile machine as shown in FIG. 1 comprises a fiber drawing-in mechanism consisting of a table 4, adjacent to which is a grooved roller 1, which butts against a fiber lap 2. The sheet of fibers released from the lap 2 is drawn across the table 4 by a feed roller 5 and led to a licker-in 6, the surface of which is provided with a toothed clothing, which catches in the fiber layer and tears fibers of fiber flocks out of it and passes them onto the main cylinder 10. Only long fibers are transferred, while short fibers and waste particles are removed from the stripping blades 8 in combination with the centrifugal force of the licker-in 6.

The teeth 11 of the card clothing of the main cylinder 10 take over the fibers from the licker-in 6, as the circumferential velocity of this main cylinder is greater than that of the licker-in 6.

Part of the circumference of the main cylinder 10 is covered by a stationary carding flat 12, the teeth 13 of which are positioned at a small clearance from the teeth 11 of the main cylinder. In FIG. 1 the clearance between the carding flat 12 on the one hand the main cylinder 10 on the other hand has been exaggerated for the sake of clarity.

Alternatively, other carding means can be provided instead of the carding flat, for instance worker rollers, revolving carding flats etc.

After leaving the space between the main cylinder 10 and the carding flat 12, the fibers are picked up by the doffer 19 and stripped off therefrom by a stripper 23 located at the delivery end of the doffer 19 and thereafter are removed from the machine as a fiber fleece 24 by calendar rollers 25 and 26. The shaft 21 of the doffer roller 19 may be adjustable in the direction as indicated by the double arrow 22.

Upstream of the fiber flow round the main cylinder 10 in a region adjacent the circumference of the main cylinder 10 on the one hand the doffer roller 19 on the other hand a first intermediate roller 14 is positioned, which is also provided with a saw-tooth wire clothing or fillet 15 and which is partially surrounded by an arcuate cover 18 located close to but at a small distance from the saw-tooth wire clothing 15 and extending over the outwardly facing peripheral region of the first intermediate roller 14. The intermediate roller 14 and the associated cover 18 are shiftable or adjustable in the direction of the double arrow 17.

The first doffer roller 19 is shiftable or adjustable in the direction of the double arrow 22.

In the direction of rotation of the main cylinder 10 downstream of the first doffer roller 19 there is provided a second doffer unit similar to the first doffer unit and comprising a second doffer roller 19' and a coordinated second intermediate roller 14'. Identical parts in the second doffer unit have been indicated by the addition of an apostrophe to the corresponding reference numerals. The fiber fleeces leaving the first pair of calendar rollers 25, 26 and the second pair of calendar rollers 25', 26' may be combined to a compound fleece.

Figure 2:
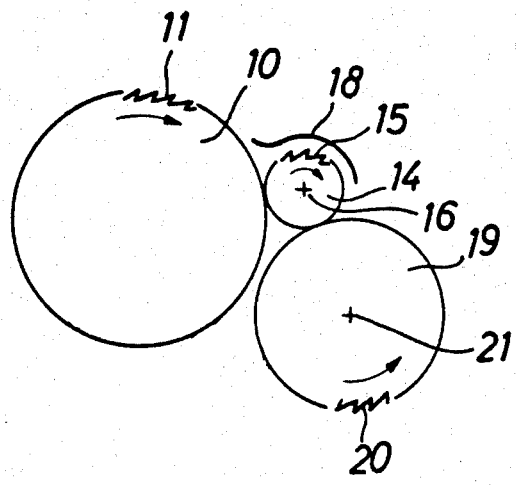
FIG. 2 is a schematic view illustrating the position of the rollers of a doffer unit for producing tangled fleece.
Figure 3:
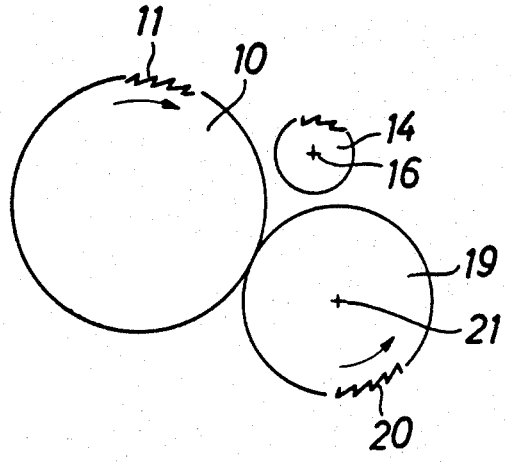
FIG. 3 is a schematical view of the position of the rollers of a doffer unit for producing a longitudinally oriented fleece.

The doffer rollers 19, 19' on the one hand and the coordinated intermediate rollers 14, 14' on the other hand may be shifted in a correlated manner into two end positions shown schematically in FIGS. 2 and 3.

In the relative position of the rollers shown in FIG. 1 and schematically in FIG. 3, the intermediate roller 14 is in an inoperative position, in which it does not affect the transfer of the fibers from the main cylinder 10 to the doffer roller 19. On the other hand, the doffer roller 19 is in such close proximity to the main cylinder 10, that it takes over at least part of the fibers from the main cylinder. In such an operating position or setting, the resulting fiber fleece consists mainly of longitudinally oriented or parallel fibers.

In the second one of the operating positions, which is shown schematically in FIG. 2, the doffer roller 19 is located at such a clearance from the main cylinder that no transfer of fibers from the main cylinder 10 to the doffer roller 19 can occur. However, the intermediate roller 14 is shifted to its end position, in which it is in operational contact with the main cylinder 10 on the one hand the doffer roller 19 on the other hand, so that the fibers are transferred from the main cylinder 10 to the intermediate roller 14 and thereafter from the latter to the doffer roller 19. The same applies for the second doffer unit comprising the second intermediate roller 14' and the second doffer roller 19'.

As may be seen from FIGS. 1 and 2, the main cylinder 10 and the intermediate rollers 14, 14' rotate in the same, clockwise direction, whereas the doffer rollers 19, 19' rotate in the opposite, counterclockwise direction.

In the aforementioned embodiment the circumferential velocity of the main cylinder is 1000 m/min and the circumferential velocity of the intermediate rollers is about 800 m/min.

Figure 4:
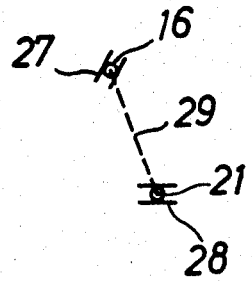
FIG. 4 is a schematical view of the bearing guides for the shafts of the intermediate roller and the doffer roller in a doffer unit.

As is described in more detail in FIG. 4, the shifting of the intermediate rollers 14, 14' on the one hand and the coordinated doffer rollers 19, 19', respectively, on the other hand is done in a correlated manner. According to FIG. 4, the shafts 16 and 21 of the intermediate roller 14 and the doffer roller 19, respectively, are guided in guide rails 27, and 28, respectively, which guide rails are orientated in the direction of the double arrows 17, and 22, respectively, shown in FIG. 1. In addition, a link bar 29 is provided shown in broken lines in FIG. 4 and by means of which the distance between the shafts 16 and 21 is adjusted.

If the doffer roller 19 is moved away from the main cylinder 10 by an appropriate shift mechanism (not shown), shaft 21 moves to the right in FIG. 4, whereas shaft 16 is forced by the link bar 29 to move in a downward direction in FIG. 4, corresponding to the end position as shown in FIG. 2. Such a link joint is described below in more detail with reference to FIG. 7.

Figure 5:
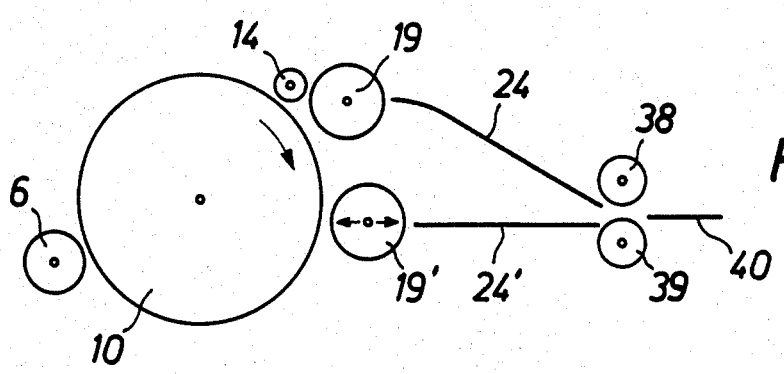
FIG. 5 is a cross-sectional view trough the rollers of a universal machine having two doffers, wherein the first doffer is cooperating with an intermediate roller.

FIG. 5 is a cross-section of a roller combination in the simplest embodiment of a universal textile machine according to the invention. It may be seen that the second doffer unit merely comprises a doffer roller 19', whereas the corresponding intermediate roller has been omitted. The fiber fleeces 24 and 24', respectively, leaving these doffer units are combined by a pair of rollers 38 and 39 and leave the textile machine as a compound fiber fleece 40.

Figure 6:
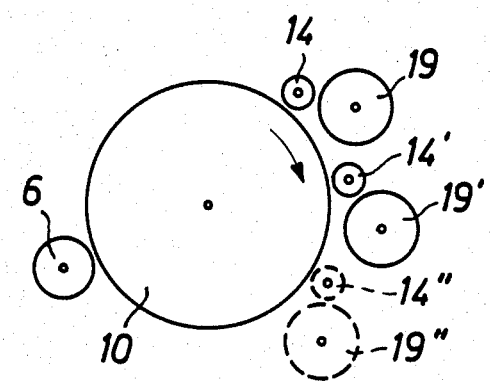
FIG. 6 is a cross-sectional view through the rollers of a universal textile machine as shown in FIG. 1.

FIG. 6 shows a roller arrangement of a universal machine according to FIG. 1, in which, however, the second intermediate roller 14' has a larger diameter than the first intermediate roller 14. The circumferential velocities of the intermediate rollers may be adjusted independently. If the first intermediate roller 14 rotates with a significantly higher speed than the second intermediate roller 14', the fibers processed by the first doffer unit 14, 19 will be tangled to a higher degree in comparison to the fibers leaving the second doffer unit 14', 19'. This results in a compound fiber fleece 40 consisting of two layers having a different degree of tangling in the fibers.

Both doffer units 14, 19 and 14', 19' may be set or adjusted so as to produce different types of fleeces. The first doffer unit 14, 19 for instance may be set to produce tangled fibers, whereas the second doffer unit 14', 19' is set to produce longitudinally oriented fibers, or vice versa.

In addition, the axial distances of the individual rollers in their respective operational setting or end position may be adjustable so as to vary the repartition of the fiber flow between both doffer units.

As is shown in FIG. 6 in dashed lines, a third doffer unit comprising a third intermediate roller 14'' and a third doffer roller 19'' may be provided, so that a compound fleece consisting of three individual layers may be produced.

Figure 7:
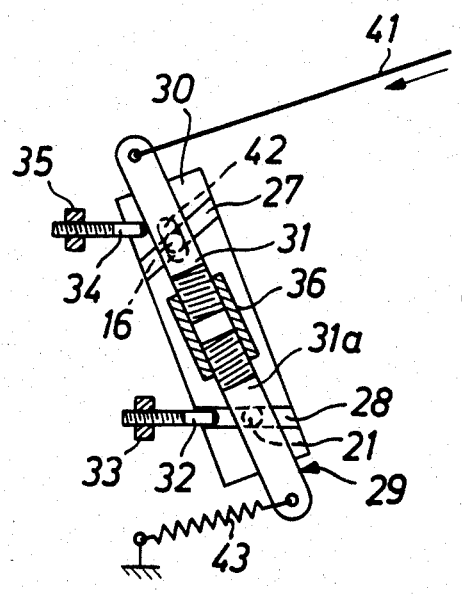
FIG. 7 is a cross-sectional view of a guide for the shafts of a doffer roller and the coordinated intermediate roller.

FIG. 7 is a side view and partial cross-section of an adjusting and link device for changing the position of the rollers of each doffer unit from one to the other end position. Such an adjusting device, which is provided on both sides of the rollers, has a guide block 30, which is provided with guide grooves 27 and 28, as already described with reference to FIG. 4. These guide grooves serve to receive the ends of shaft 16 and 21 of the intermediate roller 14 and the doffer roller 19, respectively. A link bar 29 is provided comprising two partially threaded bars 31 and 31*a*, the threaded ends of which face towards one another and are received by a barrel nut 36. Bars 31 and 31*a* each have a boring adapted to receive shaft 16 and 21, respectively. By turning the barrel nut 36, the distance between shafts 16 and 21 may be adjusted.

The adjusting device further comprises a threaded bolt 32, one end of which projects into the guide groove 28, while the threaded end is screwed into a fixed nut 33. Bolt 32 serves as a stop to define the end position corresponding to the setting as shown in FIG. 3. The free end of bar 31*a* has a coil spring 43 affixed thereto, which spring tends to pull the shaft 21 to butt against the bolt 32.

A second threaded bolt 34 is provided, which is screwed into a fixed nut 35. The free end of the second bolt serves as an abutment for the bar 31. The free end of the bar 31 is linked to a control lever 41.

In the setting or end position shown in FIG. 7, in which the intermediate roller 14 is in its active position, bar 31 butts against the second threaded bolt 34 due to the pushing action of the control lever 41 indicated by the arrow. Fine-adjustment of the clearance between the intermediate roller 14 and the main cylinder 10 in this setting is performed by turning the second threaded bolt 34.

When releasing the control lever 41, bar 31*a* is pulled against the first threaded bolt 32 by spring 43. In this other one of the end positions, the clearance between the doffer roller 19 and the main cylinder 10 may be fine-adjusted by turning the bolt 32. This setting corresponds to the operating position of FIG. 3 for the production of longitudinally oriented fiber fleece.

Since the shafts 16 and 21 are held in a definite distance by means of the link bar 29 and since the ends of the shafts are guided in the guide grooves 27 and 28 formed in the stationary or fixed guide block 30, any change of the position of the link bar 29 will result in a concurrent and coordinated change of the shafts 16 and 21. Thus, the adjusting device as shown in FIG. 7 allows the adjustment of the clearances between any pair of rollers of the main cylinder 10, the intermediate roller 14 and the doffer roller 19.

Such an adjusting device may be provided for each of the doffer units.

The aforementioned universal textile machine may be set or adjusted to manufacture a variety of individual or compound fleeces of different structures.

What is claimed is:

1. A universal textile machine for selectively producing longitudinally oriented fiber fleece and/or tangled fiber fleece, comprising a main cylinder and carding elements cooperating therewith, a fiber drawing-in device and a doffer, whose card clothings adjoin the circumferential area of the main cylinder, an intermediate roller provided with card clothing and shaft which is adapted to be positioned into a first or a second position by an adjusting device for adjusting the distance between the doffer roller and the main cylinder, wherein said positions are selected such that when the doffer roller is put into its operating position relative to the main cylinder, the card clothing of the intermediate roller is out of operational engagement relative to the card clothings of both the main cylinder and the doffer roller, and that in said second position, when the doffer roller is operationally separated from the main cylinder, the card clothing of the intermediate roller is in its operating position both relative to the card clothing of the main cylinder and of the doffer roller, and wherein the main cylinder and the intermediate roller have the same direction of rotation, characterized in that a second doffer roller is located downstream of the first doffer roller along the direction of the fiber flow around the main cylinder, and that a device for combining the individual fleeces leaving each of said doffer rollers is provided.

2. A universal textile machine as claimed in claim 1, characterised in that the second doffer roller has a second intermediate roller associated therewith and that said second doffer roller and said second intermediate roller are of the same type and are adjustable in the same way as the first doffer roller and the first intermediate roller.

3. A universal textile machine as claimed in claim 2, characterised in that each of said doffer rollers and each of said intermediate rollers has an adjusting means to adjust the clearance to the main cylinder for varying the amount of fibers transferred to each of said doffer rollers.

4. A universal textile machine as claimed in claim 2, characterised in that each of said intermediate rollers has an adjusting device for adjusting the clearance to the main cylinder in the setting for producing tangled fleece.

5. A universal textile machine as claimed in claim 4, characterised by an adjusting device for adjusting the axial distance between a doffer roller and its coordinated intermediate roller.

6. A universal textile machine as claimed in claim 2, characterised in that the speed of rotation of each of said intermediate rollers is adjustable independently of each other.

7. A universal textile machine as claimed in claim 2, characterised in that the intermediate rollers are interchangeable.

8. A universal textile machine as claimed in claim 2, characterised in that the first intermediate roller has a smaller diameter than the second intermediate roller and rotates with a greater number of revolutions.

9. A universal textile machine as claimed in claim 2, characterised in that each set of doffer roller and intermediate roller is shiftable to one of their two settings independently of each other.

10. A universal textle machine for selectively producing longitudinally oriented fiber fleece and/or tangled fiber fleece, comprising a main cylinder and carding elements cooperating therewith, a fiber drawing-in device whose fiber carding ajoins a circumferential area of the cylinder, a plurality of doffer rollers provided with card clothing and shafts and associated intermediate rollers provided with card clothing and shafts, each associated intermediate roller located immediately upstream from each associated doffer roller, means for independently moving each associated pair of doffer rollers and intermediate rollers into a first position or a second position by adjusting the distance between the doffer rollers and the main cylinder, and the intermediate roller and the main cylinder, wherein said positions are selected such that in said first position the doffer roller is put into its operating position relative to the main cylinder and the card clothing of the associated intermediate roller is out of operational engagement relative to the card clothings of both the main cylinder and the associated doffer roller, and that in said second position, the doffer roller is operationally separated from said main cylinder and the card clothing of the associated intermediate roller is in its operating position both relative to the card clothing of the main cylinder and of the associated doffer roller, wherein the main cylinder and the intermediate rollers have the same directon of rotation, and means for combining the individual fleeces leaving each of said doffer rollers.

* * * * *